United States Patent [19]

Boden

[11] 4,299,385

[45] Nov. 10, 1981

[54] RACQUET

[76] Inventor: Robert O. Boden, 1580 Gaywood Dr., Altadena, Calif. 91001

[21] Appl. No.: 65,557

[22] Filed: Aug. 10, 1979

Related U.S. Application Data

[63] Continuation-in-part of Ser. No. 926,647, Jul. 21, 1978, abandoned.

[51] Int. Cl.[3] ..... A63B 51/02

[52] U.S. Cl. ..... 273/73 D

[58] Field of Search ..... 273/73 R, 73 A, 73 C, 273/73 D, 73 E

[56] References Cited

U.S. PATENT DOCUMENTS

| | | | |
|---|---|---|---|
| 455,632 | 7/1891 | Malings | 273/73 D |
| 1,132,214 | 3/1915 | Ries et al. | 273/73 D |
| 3,834,699 | 9/1974 | Pass | 273/73 D |
| 3,999,756 | 12/1976 | Head | 273/73 D X |
| 4,013,289 | 3/1977 | Kaminstein | 273/73 D |
| 4,033,582 | 7/1977 | Linden | 273/73 D |
| 4,172,596 | 10/1979 | Linden | 273/73 D |
| 4,190,249 | 2/1980 | Fischer | 273/73 D |
| 4,231,575 | 11/1980 | Kutt et al. | 273/73 D |

FOREIGN PATENT DOCUMENTS

| | | | |
|---|---|---|---|
| 2634599 | 2/1978 | Fed. Rep. of Germany | 273/73 D |
| 2656082 | 6/1978 | Fed. Rep. of Germany | 273/73 D |
| 2730739 | 1/1979 | Fed. Rep. of Germany | 273/73 D |
| 855902 | 2/1940 | France | 273/73 D |
| 901279 | 10/1944 | France | 273/73 D |
| 5248 | of 1880 | United Kingdom | 273/73 D |
| 27052 | of 1905 | United Kingdom | 273/73 D |
| 143481 | 5/1920 | United Kingdom | 273/73 D |
| 300700 | 11/1928 | United Kingdom | 273/73 D |

*Primary Examiner*—Richard J. Apley

*Attorney, Agent, or Firm*—William P. Green

[57] ABSTRACT

A tennis racquet having a stringing pattern in which there are fewer transverse than longitudinal strings, and with the longitudinal strings being interwoven with the transverse strings and preferably being arranged in spaced pairs. The longitudinal strings may be retained against lateral displacement by transverse connectors, which in one form of the invention are cords tied by figure 8 knots to the longitudinal strings, and in another form of the invention may be elongated integrally molded elements containing preformed apertures for receiving and locating the longitudinal strings.

24 Claims, 16 Drawing Figures

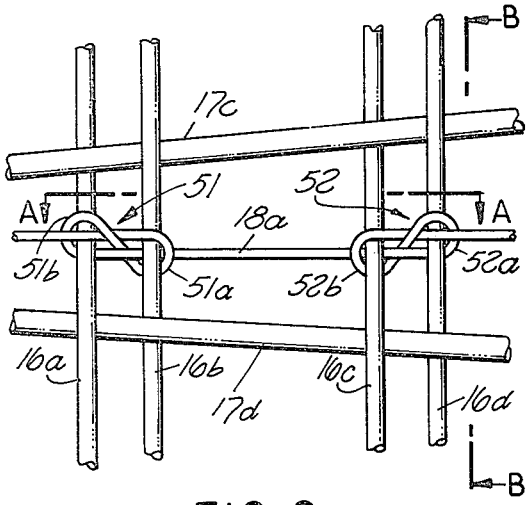
FIG. 2
FIG. 2A
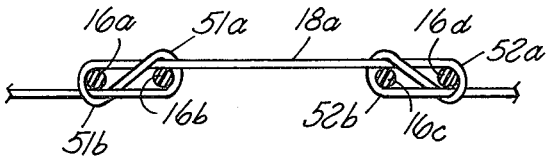
FIG. 2B
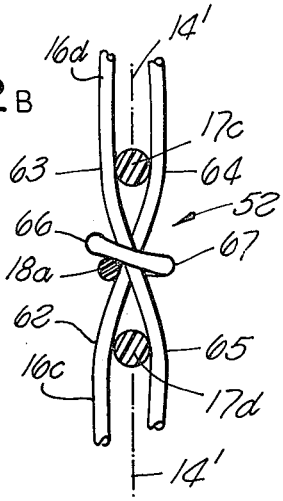
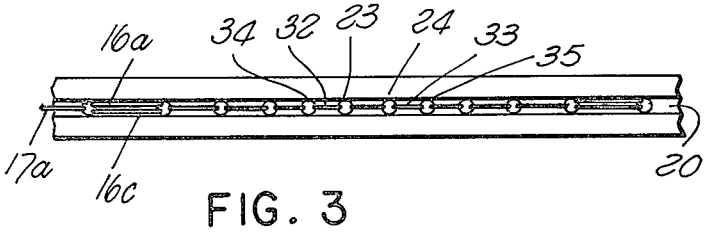
FIG. 3
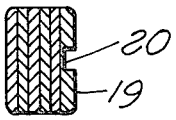
FIG. 4
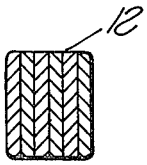
FIG. 5
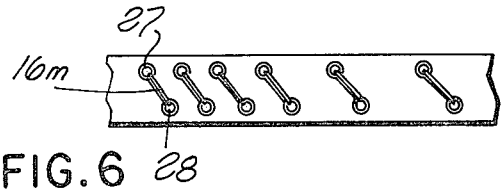
FIG. 6
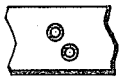
FIG. 7

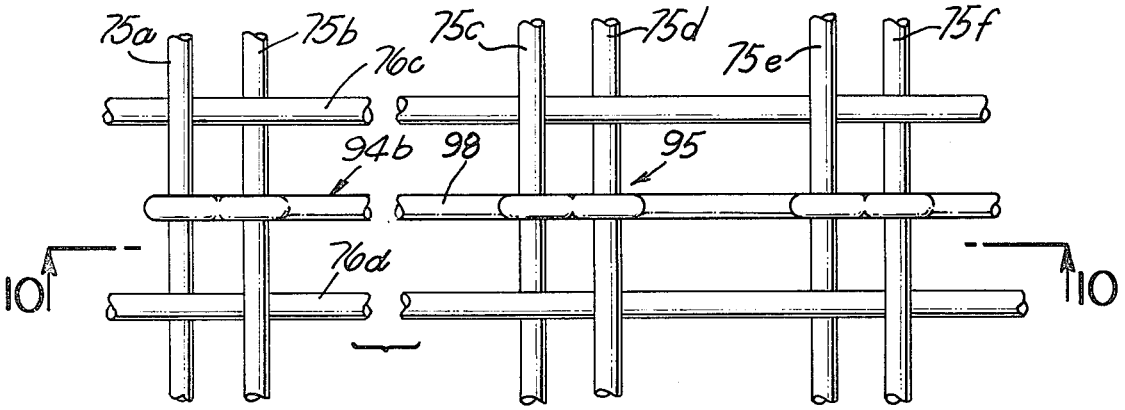
FIG. 9
FIG. 10
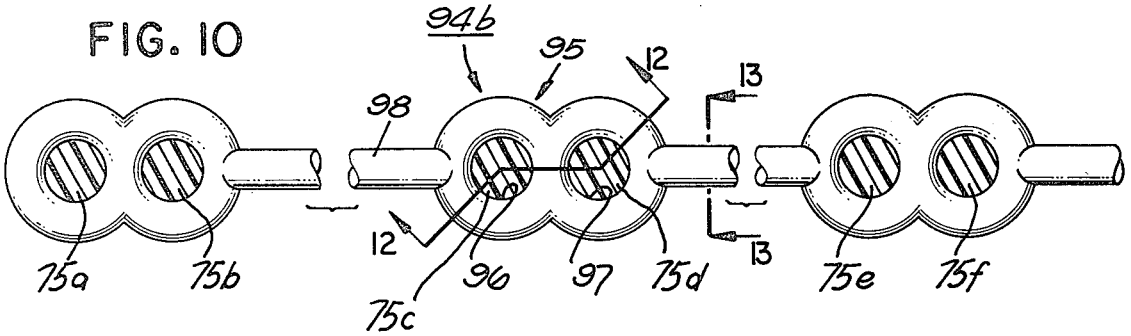
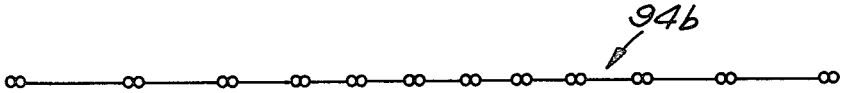
FIG. 11
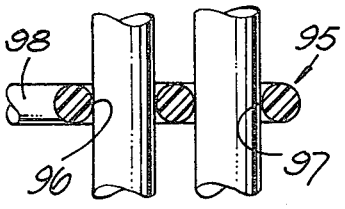
FIG. 12
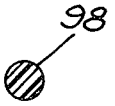
FIG. 13
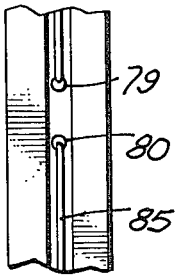
FIG. 14

RACQUET

BACKGROUND OF THE INVENTION

This application is a continuation-in-part of application Ser. No. 926,647 filed July 21, 1978, now abandoned. This invention relates to improved tennis racquets having unique stringing patterns designed to increase the control which a player has over the spin of the ball, and his control over changes in trajectory and bounce characteristics which are induced by such spin.

In an attempt to increase the spin attainable by a tennis racquet, there has previously been devised a type of racquet having a special stringing pattern and known as the "double-strung" or "spaghetti" racquet. In this racquet, the main strings which extend longitudinally of the racquet are arranged in pairs, that is, with two closely spaced strings being provided at each string location. A smaller number of transverse strings are received between the paired longitudinal strings. One longitudinal string of each pair is received in front of the transverse strings and the other behind the transverse strings with no interweaving of the longitudinal and transverse strings. The transverse strings are received within lengths of small plastic tubing to minimize friction, and the longitudinal strings are connected by transverse cords having knots attached to the longitudinal strings.

This double-strung type of racquet does in fact apparently increase the amount of spin which is attainable, as compared with a conventional racquet, but it also introduces unpredictability into the manner of response of the ball. This unpredictability is caused in part by the fact that each stroke with the racquet involves in effect a double impact with the ball, and because of the excessively irregular surface area presented by the string pattern including the spaghetti tubing and relatively large knots formed by the transverse connecting cords.

SUMMARY OF THE INVENTION

A major purpose of the present invention is to provide a racquet which will more satisfactorily attain an increased capability for development of spin on a tennis ball, but will do so without the disadvantages of the previously proposed "spaghetti" racquets. A racquet embodying the invention produces spin in a highly predictable manner, giving to the user of the racquet complete and effective control over the precise amount of overspin, underspin or side spin which is applied to the ball.

In addition to the above-discussed advantages, the novel stringing pattern of the present racquet also permits a user to hit the ball at a location further off the center of the racquet without losing control over the ball or imparting excessive twisting force to the racquet and the user's hand and arm.

For achieving these purposes, the stringing pattern of the present invention includes an arrangement in which the number of transverse strings is substantially less than the number of longitudinal strings, and in which the longitudinal strings are interwoven with the transverse strings so that a particular longitudinal string has portions received at different sides of different transverse strings. This is unlike the spaghetti racquet, in which each of the longitudinal strings extends along the same side of all of the transverse strings, and is not interwoven therewith. In my arrangement, the longitudinal strings are desirably arranged in pairs, with the two strings of each pair preferably being interwoven oppositely with respect to one another past the transverse strings. That is, when one of the strings of the pair is at a first side of a particular transverse string, the other longitudinal string of that pair is at the opposite side of the transverse string, and vice versa. Also, the two strings of each pair are preferably formed from a single length of stringing material, doubled back on itself, and in the optimum arrangement all of the longitudinal strings are formed from the same continuous piece of string material.

The transverse strings may also be formed in pairs, with greater spacing between successive pairs than between the two individual strings of a particular pair. Since the transverse strings are fewer in number than the longitudinal strings, the longitudinal strings have a tendency to flex or 'give' more than in a conventional racquet upon impact with the ball, and therefore remain in contact with the ball slightly longer to enable a greater spin to be imparted to the ball by the strings.

The longitudinal strings may be retained against unwanted lateral movement by provision of connector elements extending transversely of the racquet and each connected to a series of longitudinal strings in a relation retaining these strings against relative lateral or transverse movement. Each of the connectors is preferably located between two transverse strings of a pair of such strings. In one form of the invention, these connectors may be formed as integrally molded parts of resinous plastic material containing preformed openings through which the longitudinal strings pass in confined and located relation. In another form of the invention, the connectors may be formed as transverse cords tied to the longitudinal strings, preferably by figure 8 knots each securing one of the cords to a pair of the longitudinal strings. The sweet spot of the racquet may be increased in size by progressively increasing the spacing between successive pairs of longitudinal strings from the center of this racquet to its opposite sides.

BRIEF DESCRIPTION OF THE DRAWINGS

The above and other features and objects of the invention will be better understood from the following detailed description of the typical embodiments illustrated in the accompanying drawings, in which:

FIG. 2 is an enlarged fragmentary detail view showing a portion of FIG. 1;

FIG. 2A is a cross-sectional view taken on line A—A of FIG. 2;

FIG. 2B is a cross-sectional view taken on line B—B of FIG. 2;

FIG. 3 is a fragmentary elevational view taken on line 3—3 of FIG. 1;

FIGS. 4 and 5 are sections taken on lines 4—4 and 5—5 respectively of FIG. 1;

FIG. 6 is a fragmentary elevational view taken on line 6—6 of FIG. 1;

FIG. 7 is an enlarged fragmentary section taken on line 7—7 of FIG. 1;

FIG. 9 is an enlarged fragmentary detail view showing in enlarged form a portion of the string pattern of FIG. 8;

FIG. 10 is a fragmentary view taken on line 10—10 of FIG. 9 ;

FIG. 11 is a view taken on line 11—11 of FIG. 8;

FIGS. 12 and 13 are views showing the cross-sectional configuration of the connector of FIG. 10, and taken along lines 12—12 and 13—13 respectively of FIG. 10; and FIG. 14 is a fragmentary view taken on line 14—14 of FIG. 8.

DESCRIPTION OF THE PREFERRED EMBODIMENTS

Figure 1:
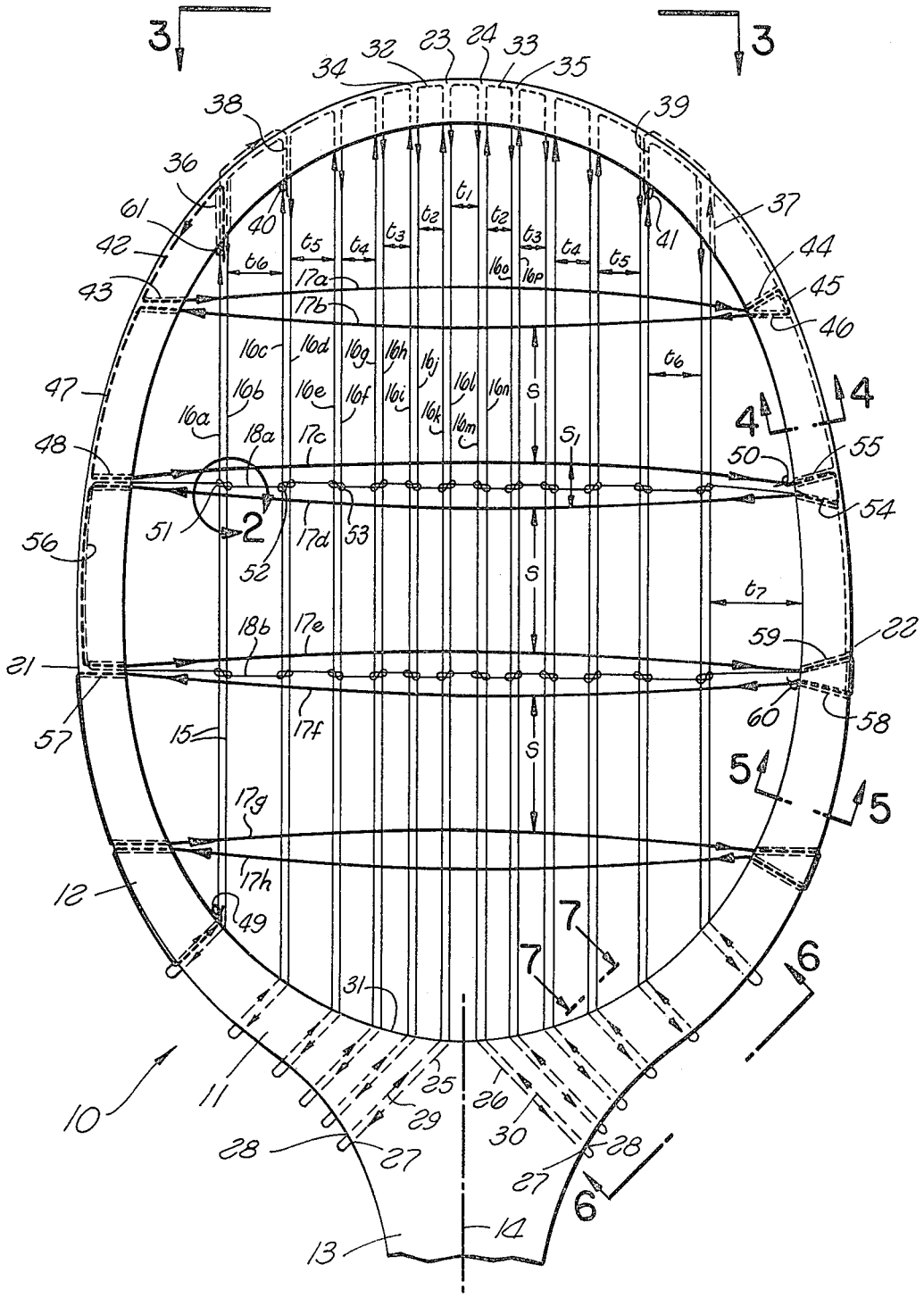
FIG. 1 is a front elevational view of a tennis racquet constructed in accordance with the invention.

Referring to FIGS. 1 to 7, the racquet 10 there shown includes a racquet body 11 which may be of conventional construction except insofar as the string receiving holes or passages in the loop or bow portion 12 of the racquet may be altered to receive the novel string pattern of the invention. The racquet body may be formed of laminated wood, metal, or any other appropriate material, and has the usual elongated handle 13 carrying and projecting from string mounting loop 12 along the longitudinal axis 14 of the racquet. The strings 15 may be formed of nylon, gut, or other appropriate stringing material, and include a series of longitudinal strings 16*a*, 16*b*, 16*c*, 16*d*, 16*e*, etc., all disposed parallel to one another and parallel to longitudinal axis 14 of the racquet, and a series of transverse strings 17*a*, 17*b*, 17*c*, 17*d*, etc. disposed perpendicular to the longitudinal strings and perpendicular to and intersecting axis 14. Two transverse cords 18*a* and 18*b* retain the longitudinal strings against transverse displacement upon impact with a ball.

Along approximately the upper one-half of the loop portion 12 of racquet body 11, desirably slightly more than the upper one-half, the outer surface 19 (FIG. 4) of that body contains a central groove 20 (FIGS. 3 and 4) recessed inwardly to receive portions of the strings of the racquet in a manner protecting them against contact with the court surface. This groove may, for example, extend from the location 21 in the left portion of FIG. 1 upwardly along the outer surface of the racquet body to the location 22. A transverse cross-section of the reinforced lower half of the loop is shown in FIG. 5. The string holes in the bottom portion of the lower half of the loop are staggered so as not to interfere with each other. See FIGS. 6 and 7.

The racquet has considerably more of the longitudinal strings 16*a*, 16*b*, 16*c*, etc. than the transverse strings 17*a*, 17*b*, 17*c*, etc. In the illustrated preferred arrangement, there are 24 of the longitudinal strings, arranged in spaced pairs as shown, and 8 of the transverse strings. The reduced number of transverse strings leaves the longitudinal strings free for greater flexure than in a conventional racquet when contacted by a ball, to thus remain in engagement with the ball for a slightly longer period of time, and thereby enable the strings to attain the desired increased spin effect. The limited number of transverse strings leaves spaces s between certain of the transverse strings which are much greater than the spacing between any two successive longitudinal strings. The longitudinal strings within these unsupported spaces are free for the discussed flexure when contacted by a ball.

The two longitudinal strings of each pair of such strings, such as for example strings 16*a* and 16*b* of FIG. 1, are spaced apart a very short distance laterally, that is, in the plane of the racquet and as viewed in FIG. 1, to maintain these two closely proximate strings against contact with one another, and thereby prevent wearing frictional movement therebetween. The second pair of strings 16*c* and 16*d* are similarly spaced, as are the strings of each of the other pairs. The spacing between the two strings of each pair may, for example, be between about 1/32 of an inch and 3/32 of an inch, desirably approximately 1/16 of an inch. The spacing between successive pairs of vertical strings is desirably at a minimum between the two central pairs 16*k* and 16*l* and 16*m* and 16*n*, as represented at $t_1$ in FIG. 1, with the spacing between pairs increasing toward opposite sides of the racquet. For example, the spacing $t_5$ between strings 16*d* and 16*e*, and the corresponding spacing $t_5$ at the opposite side of the racquet may be slightly greater than spacings $t_1$, $t_2$, $t_3$ and $t_4$, with the spacings $t_6$ between strings 16*b* and 16*c* and the corresponding strings at the opposite side of the head being still greater, and with the spacing $t_7$ between the final strings and the opposite sides of the racquet body being even greater. It is found that this progressive increase in gap dimension toward opposite sides of the racquet body increases the area within which the racquet may strike a ball without adverse effect, since the strings toward opposite sides of the racquet are less positively supported and will give to a greater extent than the central strings.

The spacing distances $t_1$, $t_2$, $t_3$ and $t_4$ near the center of the racquet may all be the same, with the spacings $t_6$ preferably increasing to a value approximately twice the central dimension $t_1$. The gaps $t_7$ may be approximately three times $t_1$. In the presently preferred arrangement, the gaps $t_1$ through $t_4$ have a width of approximately 0.34 of an inch, while the gaps $t_5$ are approximately 0.54 of an inch, the gaps $t_6$ are approximately 0.64 of an inch, and the gaps $t_7$ are approximately 0.92 of an inch.

All of the longitudinal strings 16*a*, 16*b*, etc. may be formed of a single continuous length of stringing material, either nylon or gut, easily applicable to the body of the racquet in a manner similar to a conventional stringing process. The longitudinal strings are preferably given a tension about two-thirds less than the horizontal strings, and may be formed of 16 gauge material. In the preferred arrangement, the longitudinal strings have a tension between about 27 and 30 pounds, while the horizontal strings have a tension between about 80 and 90 pounds, these tensions being as set on the stringing machine and based on installing the longitudinal strings first.

In applying the longitudinal strings to the racquet body, a length of nylon or gut cut to the proper length is doubled back at its center, and the two ends of the string are threaded downwardly or inwardly through two passages or openings 23 and 24 formed in the outer or upper extremity of the racquet body. These two portions of the string thus form the strings designated 16*l* and 16*m* in FIG. 1. At the bottom of the loop portion of the body, these strings enter two diverging passages 25 and 26 in the lower portion of the body, then emit from the extremities of those passages at 27, and are doubled back at 28 to extend through two additional passages 29 and 30 at the inner surface 31 of the frame. The stringing material the extends upwardly to form the two strings 16*k* and 16*n* of FIG. 1, and then passes upwardly again through the same openings 23 and 24 through which the opposite ends of the string were first inserted. After exiting from the passages 23 and 24, the two halves of the string extend laterally in opposite directions at 32 and 33, within groove 20, and then advance downwardly through holes 34 and 35 and then back upwardly to form two additional pairs of vertical strings 16*i* and 16*j* and 16*o* and 16*p*. In this same manner, all of the additional pairs of longitudinal strings are formed, with diverging passageways similar to passages 25 and 26, and converging passageways similar to passages 29 and 30, being formed at the lower end of each pair of strings to enable the strings to be doubled back as discussed. The extremities of this single length of stringing material which forms all of the longitudinal strings ultimately pass outwardly through a pair of top passages 36 and 37, and are then doubled back through the adjacent passages 38 and 39, and tied off to one of the vertical strings at 40 and 41 with a clove hitch.

The transverse strings 17*a*, 17*b*, 17*c*, etc. may also be formed of a single length of nylon or gut, preferably 15 gauge. This string may initially be tied off about one of the longitudinal strings by a clove hitch at 61, then passing outwardly through opening or passage 36 and down along groove 20 at 42 to an openin 43 through which the stringing material extends inwardly to form the first transverse string 17*a*. At the end of that string, the material passes outwardly through an opening or passage 44 in the body of the racquet, then a short distance within groove 20 at 45, and ultimately back through a passage 46 which converges relative to passage 44. The second transverse run or string 17*b* is then formed, at the end of which the stringing material passes again through the previously mentioned opening 43, then downwardly along groove 20 at 47 to another opening 48 at which the second pair of transverse strings 17*c* and 17*d* are formed in the same manner as the first pair 17*a* and 17*b*. This stringing procedure continues through the third pair of transverse strings 17*e* and 17*f* and the fourth pair 17*g* and 17*h*, with the second end of the stringing material being tied off by a clove hitch at 49 to longitudinal string 16*a*. The spacing s between successive pairs of transverse strings is desirably considerably greater than each of the spacing distances $t_1$, $t_2$, through $t_6$ between the pairs of longitudinal strings. Preferably, the spacing s is several times as great as the spacing $t_1$, and at least about two and one-half times as great as the spacing $t_6$. In the currently preferred arrangement, the spacing s between successive pairs of transverse strings is approximately $1\frac{3}{4}$ inches, while the spacing $s_1$ between the two transverse strings of each pair is approximately $\frac{3}{8}$ of an inch.

Each longitudinal string as it advances past the successive transverse strings is interwoven therewith to be received at opposite sides of different ones of the transverse strings. For example, the initial longitudinal string 16*a* in the left portion of FIG. 1, as it advances downwardly in that figure, first extends downwardly along the back side of the top transverse string 17*a*, and then extends forwardly to be received at and pass downwardly along the front side of string 17*b*. The same string then is received at the back side of string 17*c*, and the front side of string 17*d*, etc. to the bottom of the racquet. The second longitudinal string 16*b* extends along the forward side of string 17*a*, then the back side of string 17*d*, etc., to interfit with the transverse strings in a manner the opposite of the first longitudinal string 16*a*. In the second pair of strings 16*c* and 16*d*, the string 16*c* extends along the back side of string 17*a*, the front of string 17*b*, etc. in the same manner as string 16*a*, and the string 16*d* follows the weaving pattern of string 16*b*. In each of the other pairs of longitudinal strings, the left one of the strings of that pair interfits with the transverse strings in the same manner as string 16*a*, and the right string of the pair interfits with the transverse strings in the same manner as string 16*b* (see FIG. 2).

The two positioning cords 18*a* and 18*b* are formed of nylon or other material having a smaller diameter (desirably 21 gauge) than either the longitudinal or transverse strings. These two cords 18*a* and 18*b* may be formed of a single length of such material, tied off at its opposite ends to two of the transverse strings at 50 and 60. Cord 18*a* may be received between the two transverse strings 17*c* and 17*d*, and is tied to each of the pairs of longitudinal strings by a figure 8 knot. As seen in FIGS. 2 and 2A, the knot 51 is formed by first looping the cord material about string 16*b* at 51*a*, then looping it about string 16*a* at 51*b* to form a figure 8 defining two slightly spaced loops which accurately locate and retain the two longitudinal strings in closely proximate but slightly spaced relation. The second figure 8 knot 52 is reversed with respect to the first knot 51, as seen in FIGS. 2 and 2A, so that to the left of the first pair of strings 16*a* and 16*b*, the cord material is received in a plane essentially in front of the two strings 16*a* and 16*b*, while in extending from knot 51 to knot 52 the cord is received in a plane spaced rearwardly and essentially behind the two cords 16*a* and 16*b*. Similarly, extending between the two knots 52 and 53, the cord material is again received in the forward plane essentially in front of the longitudinal strings, with this alternating continuing across the entire width of the racquet. The same is true of the various knots formed by lower cord 18*b*. At its extremities, the material forming cords 18*a* and 18*b* passes outwardly through a passage 54 in the body, and is then doubled back inwardly through a converging passage 55 to the retaining knot 50. At the second end of cord 18*a*, the cord material extends outwardly through passage 48, and then downwardly within groove 20 at 56, to enter a passage 57 for forming the second cord 18*b*. The converging passages 58 and 59 at the second extremity of the cord are of course essentially the same as the discussed passages 54 and 55.

Figure 8:
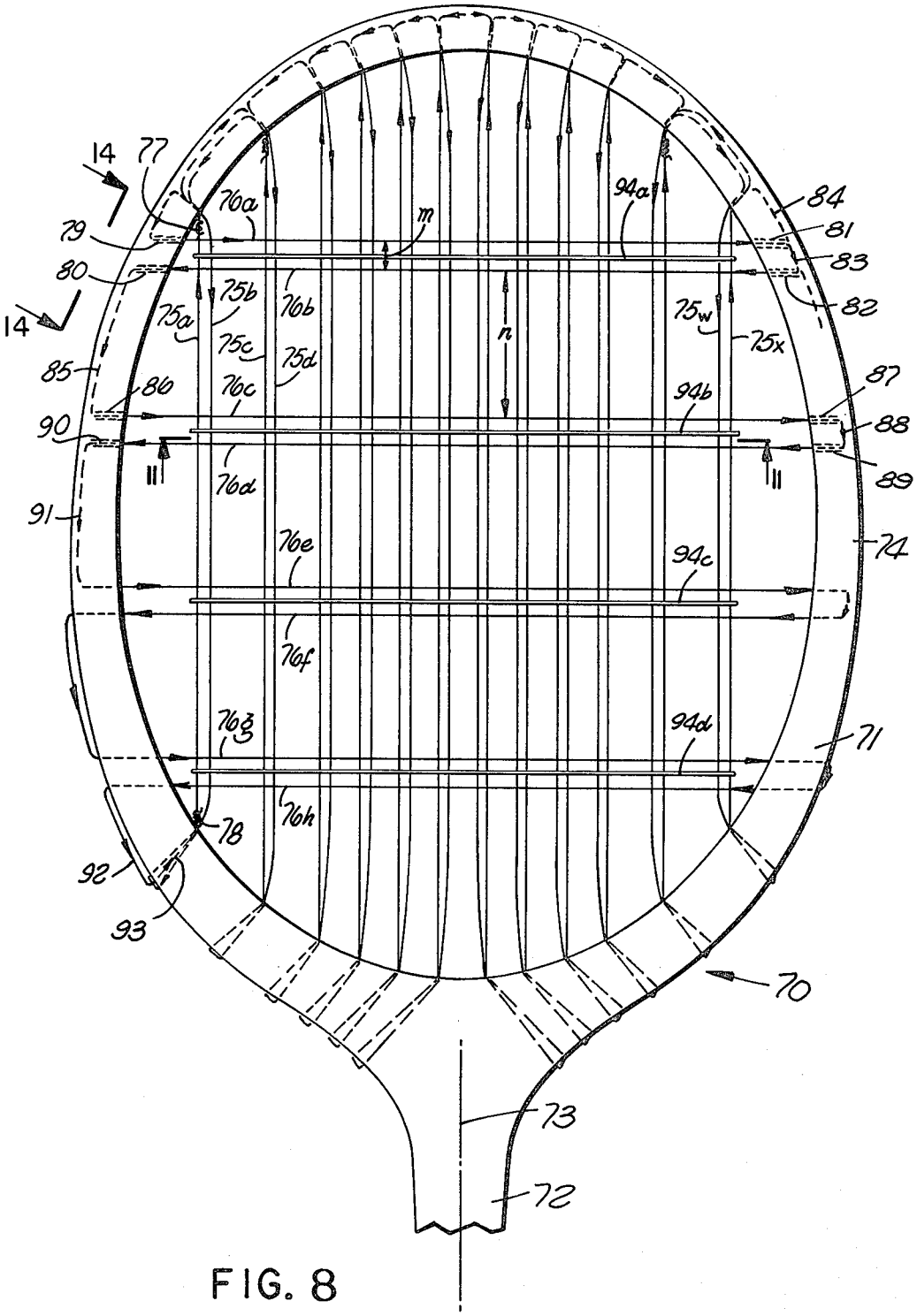
FIG. 8 is a view similar to FIG. 1 but showing a variational form of the invention.

Locating each of the positioning cords 18*a* and 18*b* between the components of a pair of transverse strings insures that the figure 8 knots will have negligible effect on ball response and also protects the positioning cords, which are smaller in diameter than the other strings, from premature breakage due to repeated ball impact. This can be seen by examining cord 18*a* in FIG. 2B. The points 62 through 67 represent the outermost points of the strings as measured from the central plane 14' of the racquet head, the points 66 and 67 being only slightly further out than the others. Specifically, the relatively steep, mutually opposing slopes of the portions of the longitudinal strings between the transverse strings 17*c* and 17*d* prevent longitudinal movement of cord 18*a*. This means that points 66 and 67 will maintain as low a profile as possible. Furthermore, for example, if the ball impacts dead center on cord 18*a* at point 66, then the bulk of the load will be shared about equally at points 62, 63 and 66, thus sparing point 66 from excessive load conditions.

In using the racquet of FIGS. 1 to 7, when a player strikes the ball with a glancing blow, the longitudinal strings 16*a*, 16*b*, etc. exert a very effective spinning force against the ball, since the increased flexure or give of these longitudinal strings enables them to remain in contact with the ball of an increased period of time during which the glancing motion may be transmitted from the racquet to the ball. In this way, increased spin of any type may be applied to the ball, with a resultant change in the course of travel of the ball. The low profile figure 8 knots formed by the small diameter cords 18*a* and 18*b* do not project outwardly beyond the other strings far enough to adversely affect the flight of the ball, and yet maintain the longitudinal strings very positively against unwanted lateral displacement. the overall effect is an increased spinning motion of the ball, but one which is predictable and controllable.

Referring now to FIGS. 8 through 14, the variational form of tennis racquet shown in those figures at 70 may be the same as that shown in FIGS. 1 to 7 except with respect to the differences specifically discussed hereinbelow. Racquet 70 has a body 71 having an elongated handle 72 extending along a longitudinal axis 73 of the racquet, with the handle carrying a loop portion 74 of the body within which the strings are carried. The longitudinal strings may all be formed of a single length of stringing material, applied to the racquet body in the same pattern discussed in connection with the first form of the invention, to form a number of pairs of longitudinal strings 75*a*, 75*b*, 75*c*, 75*d*, etc., corresponding to strings 16*a*, 16*b*, etc. of FIG. 1, with the individual strings of each pair being in closely spaced relation, and with the spacing between successive pairs being greater than that between the individual strings of a particular pair. Also, the spacing between successive pairs may progressively increase toward the opposite sides of the racquet body, in the same manner discussed in connection with FIG. 1.

The transverse strings 76*a*, 76*b*, 76*c*, 76*d*, 76*e*, 76*f*, 76*g* and 76*h* are similar to strings 17*a*, 17*b*, etc. of FIG. 1, except that the transverse strings in FIG. 8 are all directly parallel to one another along their entire length, instead of being of the bowed configuration seen in FIG. 1. The transverse strings 76*a*, 76*b*, etc. of FIG. 8 are all formed of a single length of stringing material, as in FIG. 1, with one end of that length of material being tied to longitudinal string 75*a* at 77, and with the second end of the transverse stringing material being tied to string 75*a* at 78. In order to maintain the desired parallelism of the transverse strings 76*a* and 76*b* in FIG. 8, the left ends of those strings as viewed in that figure do not extend through a common opening in the manner of FIG. 1, but rather extend through two spaced parallel openings 79 and 80 in the loop portion of the racquet. Similarly, at the right end of strings 76*a* and 76*b*, the stringing material extends through a second pair of spaced parallel openings 81 and 82 in the loop portion of the racquet, with the spacing between openings 81 and 82 being the same as between openings 79 and 80. The stringing material is doubled back from one of these openings 81 to the other opening 82 at 83, with the portion 83 being received within a protective groove 84 in the loop portion of the racquet. At the left end of string 76*b*, the stringing material which forms the transverse strings extends downwardly at 85 within a groove in the loop portion of the racquet, and then extends inwardly through a passage 86 to form string 76*c*, with the right end of that string extending through an opening 87, then being doubled back at 88, and extending inwardly through a parallel opening 89 to form the second string 76*d* of the second pair of transverse strings, and with the stringing material ultimately passing through an opening 90 at the left end of string 76*d*, and extending downwardly at 91 to the third pair of transverse strings 76*e* and 76*f*. This third pair of strings are formed in parallel fashion in the same manner discussed in connection with the pairs 76*a* and 76*b* and 76*c* and 76*d*, and ultimately the final pair of transverse parallel strings 76*g* and 76*h* are formed in the same manner, with the stringing material at the left end of string 76*h* extending downwardly at 92 and then inwardly through passage 93 to the anchoring point 78. Thus, both the left and right end of each of the transverse strings extends through an individual opening, separate from the openings through which the ends of the second string of the same pair of transverse strings extends.

The two transverse strings of each pair (e.g. strings 76*a* and 76*b*) are in fairly closely spaced relation, as represented at m in FIG. 8, with the spacing n between successive pairs of the transverse strings being considerably greater than, and desirably several times as great as, the spacing m between the individual transverse strings of a particular pair. The spacing n is also desirably greater than any of the spaces between successive pairs of longitudinal strings, as in the first form of the invention.

Another difference between the arrangement of FIGS. 8 to 14 and that of FIGS. 1 to 7 resides in the structure of a series of connector elements 94*a*, 94*b*, 94*c* and 94*d* which are utilized in FIG. 8 in lieu of the cords 18*a* and 18*b* of FIGS. 1 to 7. In FIG. 8, each of the connector elements 94*a*, 94*b*, etc. may be injection molded or otherwise preformed to the configuration illustrated in the drawings, desirably being formed of an appropriate strong resinous plastic material, such as nylon. Referring particularly to the connector element 94*b* which is illustrated in detail in FIGS. 9 to 13, this connector is an elongated element of a length to extend the entire distance from the left-hand pair of longitudinal strings 75*a* and 75*b* to the right-hand pair of longitudinal strings 75*w* and 75*x* and to interconnect all of the longitudinal strings against relative lateral displacement. At the location of each of the pairs of longitudinal strings, connector 94*b* has an enlargement 95 containing two circular openings 96 and 97 dimensioned to exactly receive and closely confine and locate two of the longitudinal strings passing therethrough. Between successive enlargements 95, the connector 94*b* has reduced dimension desirably cylindrical portions 98, of a size and strength to successfully resist stretching under the forces exerted against this part by the strings in use. As the longitudinal stringing material is threaded onto the racquet, the various longitudinal strings are passed through the corresponding openings 96, 97, etc. of each of the four identical connectors 94*a*, 94*b*, 94*c* and 94*d*. After the longitudinal strings have been applied to the racquet in the pattern illustrated, pulled tight, and then retained in place by knots at the opposite ends of the longitudinal stringing material, the transverse stringing material is applied in the pattern illustrated and heretofore discussed, with the transverse strings being interwoven with the longitudinal strings in the same pattern described in great detail in connection with FIGS. 1 to 7. Thus each of the longitudinal strings in advancing past a series of transverse strings passes those strings alternately at the front and back sides. Each longitudinal string is also woven oppositely from the two adjacent longitudinal strings, so that where one longitudinal string is at the front of a particular transverse string, the two adjacent longitudinal strings are at the back of the same string. Similarly, each transverse string is woven through the longitudinal strings to be received in front of and behind alternate longitudinal strings, and where one transverse string is received at the front of a particular longitudinal string, the two adjacent transverse strings are received behind the same longitudinal string, all in a manner corresponding to the FIGS. 1 to 7 weaving pattern.

When the racquet of FIGS. 8 to 14 is in use, the increased freedom for flexure of the longitudinal strings as compared with a conventional racquet permits greater spin to be imparted to a ball, while the connector elements 94*a*, 94*b*, 94*c* and 94*d* retain the longitudinal strings against lateral displacement at the locations at which these connectors engage the longitudinal strings, to thereby prevent substantial movement of the longitudinal strings relative to the transverse strings at the points at which the strings cross one another, and thus prevent wear of the strings from such relative movement. To achieve this result, the material from which connectors 94*a*, 94*b*, etc. are formed should be strong enough to prevent elongation of any of these connectors under the forces encountered in use, so that the connectors like the cords of FIGS. 1 to 7 will retain the longitudinal strings against relative lateral separating movement and in effect hold all of the longitudinal strings in essentially fixed positions relative to one another. By positioning each of the connectors between two relatively closely spaced transverse strings, a single connector can serve the function of preventing lateral displacement of the longitudinal strings at the location of each of two transverse strings, thus minimizing the number of connectors 94*a*, etc. which must be utilized, and also minimizing the difficulty required in threading the longitudinal strings through the openings in connectors 94*a*, 94*b*, etc.

In order to maximize the effectiveness with which connectors 94*a*, 94*b*, etc. retain the longitudinal strings against relative lateral movement, it is desirable that the openings 96 and 97 in the connectors be so located that any lateral forces exerted by the longitudinal strings on the portions 98 of the connectors between successive pairs of longitudinal strings be tensional and not compressional. More specifically, the openings should desirably be so located that in each pair of longitudinal strings the individual string of that pair which is closer to axis 73 (e.g. strings 75*b*, 75*d* or 75*w*, etc.) is bowed slightly inwardly toward that axis, while the string which is farther from the axis (75*a*, 75*c*, 75*x*, etc.) is straighter and preferably is perfectly straight or bowed to a lesser extent in a direction toward the axis, and is not bowed away from the axis.

While certain specific embodiments of the present invention have been disclosed as typical, the invention is of course not limited to these particular forms, but rather is applicable broadly to all such variations as fall within the scope of the appended claims.

I claim:

1. A racquet comprising:

a racquet body having a loop portion and a handle portion projecting therefrom; and longitudinal and transverse strings carried by said loop portion of the body and crossing one another;

said transverse strings being fewer in number than said longitudinal strings;

said longitudinal strings in advancing past successive transverse strings being interwoven therewith so that an individual longitudinal string has portions received at different sides of different transverse strings;

said longitudinal strings being arranged in pairs with the two strings of each pair being closely proximate one another and with successive pairs being spaced apart a distance greater than the individual strings of a pair;

the two strings of one of said pairs being formed of a single continuous length of string material doubled back on itself at one end of said two strings of that pair;

the opposite ends of said two strings of said pair extending through a common opening in said loop portion of the racquet body and then extending laterally in opposite directions from said opening to form two additional pairs of the strings.

2. A racquet comprising:

a racquet body having a loop portion and a handle portion projecting therefrom; and longitudinal and transverse strings carried by said loop portion of the body and crossing one another;

said transverse strings being fewer in number than said longitudinal strings;

said longitudinal strings in advancing past successive transverse strings being interwoven therewith so that an individual longitudinal string has portions received at different sides of different transverse strings;

said longitudinal strings being arranged in pairs with the two strings of each pair being in closely proximate relation and with successive pairs being spaced apart farther than the individual strings of a pair;

a series of said pairs of strings being formed of a single continuous length of string material which is doubled back within passages in said loop portion of the body at first ends of the pairs;

the two strings of each pair at their second ends extending through a common opening in said loop portion of the racquet body and then extending laterally in opposite directions to form two additional pairs of longitudinal strings.

3. A racquet comprising:

a racquet body having a loop portion and a handle portion projecting therefrom; and longitudinal and transverse strings carried by said loop portion of the body and crossing one another;

said transverse strings being fewer in number than said longitudinal strings;

said longitudinal strings in advancing past successive transverse strings being interwoven therewith so that an individual longitudinal string has portions received at different sides of different transverse strings;

said longitudinal strings being arranged in pairs with the two strings of each pair being closely proximate one another but spaced slightly apart in the direction of extension of said transverse strings;

successive pairs of said longitudinal strings being spaced apart distances greater than the spacing between the two strings of an individual pair;

the spacing between said pairs increasing progressively from a central location toward opposite sides of said loop portion of the racquet body;

said pairs of longitudinal strings all being formed of a single continuous length of string material which is doubled back within passages in the loop portion of said body at first ends of the longitudinal strings;

the two strings of each pair at their second ends extending through a common opening and then extending laterally in opposite directions to the locations of two adjacent pairs.

4. A racquet as recited in claim 3, in which said transverse strings are arranged in pairs all formed of a single continuous length of string material, the two longitudinal strings of a particular pair of such strings being interwoven oppositely with a pair of transverse strings so that the two longitudinal strings of a pair are received at first and second sides respectively of a first transverse string and then reverse positions to the opposite sides of the second transverse string of the same pair.

5. A racquet as recited in claim 4, including positioning elements extending transversely across said loop portion of the racquet body at locations longitudinally between the transverse strings of said pairs and connected to the pairs of longitudinal strings to hold them against transverse displacement.

6. A racquet comprising:

a racquet body having a loop portion and a handle portion projecting therefrom;

longitudinal strings carried by said loop portion of the body and extending longitudinally of the racquet body and said handle portion thereof;

transverse strings carried by said loop portion of the body;

said longitudinal and transverse strings being interwoven so that individual longitudinal strings in passing a series of transverse strings are received alternately at front and rear sides thereof, and individual transverse strings in passing a series of longitudinal strings are received alternately at front and rear sides thereof;

said transverse strings being fewer in number than said longitudinal strings; and at least one connector extending transversely of the racquet body and having portions extending about different longitudinal strings in a relation interconnecting the longitudinal strings against relative transverse movement at the location of the connector;

said connector being attached to said longitudinal strings at locations so spaced that the longitudinal strings apply tensional force on the connector at some locations between successive longitudinal strings.

7. A racquet comprising:

a racquet body having a loop portion and a handle portion projecting therefrom;

longitudinal strings carried by said loop portion of the body and extending longitudinally of the racquet body and said handle portion thereof;

transverse strings carried by said loop portion of the body;

said longitudinal and transverse strings being interwoven so that individual longitudinal strings in passing a series of transverse strings are received alternately at front and rear sides thereof, and individual transverse strings in passing a series of longitudinal strings are received alternately at front and rear sides thereof;

said transverse strings being fewer in number than said longitudinal strings; and at least one connector extending transversely of the racquet body and having portions extending about different longitudinal strings in a relation interconnecting the longitudinal strings against relative transverse movement at the location of the connector;

said longitudinal strings being arranged in pairs with the two strings of each pair being in close proximity to one another and with successive pairs being spaced farther from one another than are the two strings of each pair;

said connector being attached to said longitudinal strings at locations so spaced that in said pairs of longitudinal strings the individual string of a pair which is located closer to the central longitudinal axis of the racquet is bowed inwardly toward that axis and the second string of the pair located farther from the axis is straighter than the first.

8. A racquet comprising:

a racquet body having a loop portion and a handle portion projecting therefrom;

longitudinal strings carried by said loop portion of the body and extending longitudinally of the racquet body and said handle portion thereof;

transverse strings carried by said loop portion of the body;

said longitudinal and transverse strings being interwoven so that individual longitudinal strings in passing a series of transverse strings are received alternately at front and rear sides thereof, and individual transverse strings in passing a series of longitudinal strings are received alternately at front and rear sides thereof;

said transverse strings being fewer in number than said longitudinal strings; and a plurality of connectors extending transversely of the racquet body at longitudinally spaced locations and each having portions extending about different longitudinal strings in a relation interconnecting the longitudinal strings against relative transverse movement at the location of the connector;

said longitudinal strings being arranged in pairs with the two strings of each pair being in close proximity to one another and with successive pairs being spaced farther from one another than are the two strings of each pair;

said transverse strings being arranged in pairs, with successive pairs of such strings being spaced farther apart than are the individual strings of a pair;

each of said connectors being received between the two transverse strings of one of said pairs of such strings;

each of said connectors extending across the major portion of the width of the loop portion of the racquet body at the location at which that particular connector is positioned and having portions extending about the individual longitudinal strings to interconnect the strings against relative transverse movement;

the spacing between successive pairs of longitudinal strings increasing progressively from a central location to opposite sides of said loop portion of the body;

said transverse strings being larger in diameter than said longitudinal strings, and being pulled more tightly than said longitudinal strings;

said connectors being attached to said longitudinal strings at locations so spaced that in said pairs of longitudinal strings the individual string of a pair which is located closer to the central longitudinal axis of the racquet is bowed inwardly toward that axis and the second string of the pair located farther from the axis is essentially straight.

9. A racquet comprising:

a racquet body having a loop portion and a handle portion projecting therefrom;

longitudinal strings carried by said loop portion of the body and extending longitudinally of the racquet body and said handle portion thereof;

transverse strings carried by said loop portion of the body and fewer in number than said longitudinal strings and arranged in pairs, with successive pairs of said transverse strings being spaced farther apart than are the individual strings of a pair;

said longitudinal and transverse strings being interwoven so that individual longitudinal strings in passing a series of transverse strings are received in front of some transverse strings and behind others, and individual transverse strings in passing a series of longitudinal strings are received in front of some longitudinal strings and behind others; and at least one connector extending transversely of the racquet body at a location between the two transverse strings of one of said pairs, and having portions extending about different longitudinal strings and interconnecting them against relative transverse movement at the location of the connector, with some of said longitudinal strings being received in front of a first of said two transverse strings and behind the second and being retained by the connector therebetween, while others of said longitudinal strings are received behind said first transverse string and in front of the second and are retained by the connector therebetween.

10. A racquet as recited in claim 9, in which there is at least one additional connector spaced from said first mentioned connector and extending about different longitudinal strings and interconnecting them against relative transverse movement at a location between the two transverse strings of a second of said pairs of such strings, with some of the longitudinal strings being received in front of one transverse string of said second pair and behind the other and others of said longitudinal strings being received behind said one transverse string of said second pair and in front of the other.

11. A racquet as recited in claim 9, in which said connector is an elongated element containing openings through which said longitudinal strings extend in located relation.

12. A racquet as recited in claim 9, in which said longitudinal strings are arranged in pairs with the two strings of each pair being in close proximity to one another and with successive pairs being spaced farther from one another than are the two strings of each pair.

13. A racquet as recited in claim 9, in which said longitudinal strings are arranged in pairs with the two strings of each pair being in close proximity to one another and with successive pairs being spaced farther from one another than are the two strings of each pair, one of the strings of each of said pairs of longitudinal strings being received in front of said first transverse string and behind the other while the second longitudinal string of each pair is received behind said first transverse string and in front of the other.

14. A racquet as recited in claim 9, in which said longitudinal strings are arranged in pairs with the two strings of each pair being in close proximity to one another and with the spacing between successive pairs increasing progressively from a central location to opposite sides of said loop portion of the body.

15. A racquet as recited in claim 9, in which said two transverse strings of said one pair thereof have their ends in close proximity and are bowed in opposite directions away from one another to positions of increased spacing with respect to one another intermediate said ends.

16. A racquet as recited in claim 9, in which the two transverse strings of one of said pairs thereof have corresponding ends extending through a single opening formed in said loop portion of the racquet body.

17. A racquet as recited in claim 9, in which said connector includes a cord extending transversely across said loop portion of said racquet body and tied to said longitudinal strings to retain them against lateral displacement.

18. A racquet as recited in claim 9, in which said connector is a cord having figure 8 knots each attaching the cord to two of said longitudinal strings.

19. A racquet as recited in claim 9, in which said transverse strings are larger in diameter than said longitudinal strings.

20. A racquet as recited in claim 9, in which said longitudinal strings are arranged in pairs with the two strings of each pair being in close proximity to one another and with successive pairs being spaced farther from one another than are the two strings of each pair, there being at least one additional connector extending transversely of the racquet body and spaced from said first connector and received between the two transverse strings of a second of said pairs of such strings, one longitudinal string of each of said pairs of longitudinal strings being received in front of one of the two transverse strings of each of said first and second pairs of transverse strings and behind the other, while the other longitudinal string of each pair is received behind said one transverse string of each of said first and second pairs of transverse strings and in front of the other, each of said connectors extending across the major portion of the width of the loop portion of the racquet body at the location at which that particular connector is positioned and having portions extending about the individual longitudinal strings to interconnect the strings against relative transverse movement.

21. A racquet as recited in claim 20, in which the spacing between successive pairs of longitudinal strings increases progressively from a central location to opposite sides of said loop portion of the body.

22. A racquet as recited in claim 21, in which said transverse strings are larger in diameter than said longitudinal strings, and are pulled more tightly than said longitudinal strings.

23. A racquet as recited in claim 22, in which said connector is attached to said longitudinal strings at locations so spaced that in said pairs of longitudinal strings the individual string of a pair which is located closer to the central longitudinal axis of the racquet is bowed inwardly toward that axis and the second string of the pair located farther from the axis is essentially straight.

24. A racquet as recited in claim 20, in which each of said longitudinal strings in passing a series of transverse strings is received alternately at front and rear sides thereof, and each of said transverse strings in passing a series of longitudinal strings is received alternately at front and rear sides thereof.

* * * * *